US006644531B2

(12) United States Patent
Yamamoto et al.

(10) Patent No.: US 6,644,531 B2
(45) Date of Patent: Nov. 11, 2003

(54) STRUCTURE AND METHOD FOR FITTING MAGAZINE TO NOSE MEMBER OF NAILING MACHINE

(75) Inventors: Hiroki Yamamoto, Tokyo (JP); Tatsushi Ogawa, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 09/911,423

(22) Filed: Jul. 25, 2001

(65) Prior Publication Data

US 2002/0014511 A1 Feb. 7, 2002

(30) Foreign Application Priority Data

Jul. 25, 2000 (JP) ..... 2000-224446

(51) Int. Cl.[7] ..... B25C 5/02; B25C 7/00; B27F 7/00; B25D 5/00; B25D 17/11

(52) U.S. Cl. ..... 227/120; 227/140; 173/162.1

(58) Field of Search ..... 173/162.1, 162.2; 227/120, 140, 119, 136; 403/334, 179, 291

(56) References Cited

U.S. PATENT DOCUMENTS

| | | | | | |
|---|---|---|---|---|---|
| 3,905,535 | A | * | 9/1975 | Novak et al. | 227/120 |
| 4,197,974 | A | * | 4/1980 | Morton et al. | 227/120 |
| 4,585,154 | A | * | 4/1986 | Fealey et al. | 227/120 |
| 4,597,517 | A | * | 7/1986 | Wagdy | 227/120 |
| 4,930,673 | A | * | 6/1990 | Pfister | 227/120 |
| 5,083,694 | A | * | 1/1992 | Lemos | 227/120 |

* cited by examiner

*Primary Examiner*—Anthony D. Stashick
(74) *Attorney, Agent, or Firm*—Morgan, Lewis & Bockius LLP

(57) ABSTRACT

A nailing machine includes a nose member disposed in the leading end portion of a main body of the nailing machine for driving the leading nail of stick-shaped connected nails supplied thereto, and a magazine mounted in an opening formed in the side surface of the nose member for sequentially supplying the connected nails to the nose member. When the magazine is fit to the nose member, an elastic member is pressed in into a clearance provided between the nose member and the magazine.

13 Claims, 3 Drawing Sheets

STRUCTURE AND METHOD FOR FITTING MAGAZINE TO NOSE MEMBER OF NAILING MACHINE

BACKGROUND OF THE INVENTION

1. Field of the Invention

The present invention relates to a method for fitting a magazine to a nose member, for driving a nail, disposed on the leading end portion of a nailing machine. Further, the present invention relates to a structure of a nailing machine and a nailing machine including the structure.

2. Description of the Related Art

Generally, a nailing machine is provided with a nose member on the leading end portion thereof. The nose member is used not only to guide a nail hammering driver in a slidable manner but also to drive out a nail. On one side of the nose member, a magazine in the shape of a straight-sheath is provided so that connected nails loaded into the magazine can be supplied from an opening formed on one side of the nose member. Further, the nose member and the magazine are molded separately from each other, and the magazine is fixed to the nose member.

The nose member is molded with lost wax process. On the other hand, the magazine is composed of an extruded member made of aluminum. That is, since the nose member and the magazine are produced according to different forming methods, it is difficult to accurately fit the dimensions of them to each other. When the magazine is fixed to the nose member by using a bolt, it needs a dimensional tolerance between the nose member and the magazine. Therefore, there inevitably appears a clearance between the nose member and the magazine.

However, this clearance causes vibrations when a nailing machine is used. That is, each time the nailing machine drives a nail, the nailing machine bounces up from the surface of a driven member due to reaction caused by the driving operation. As a result, the magazine is greatly shaken and vibrated due to the impulse caused by the bouncing nailing machine, thereby causing the nose member and magazine to rattle with respect to each other. Thus, if such vibrations occur repeatedly, there is a possibility that the magazine may be broken.

If the clearance is eliminated, the above problem can be solved. However, in a case where component members are molded according to different molding methods, a tolerance of dimension must be taken into consideration. Furthermore, if the dimension of the clearance is set severely, there is a fear that it is difficult or impossible to fit the magazine to the nose member.

SUMMARY OF THE INVENTION

The present invention aims at eliminating the above drawbacks. Accordingly, it is an object of the present invention to provide a method for fitting a magazine to the nose member of a nailing machine, which not only provides a clearance as an allowance for a dimensional tolerance between the nose member and the magazine, but also eliminates a possibility that the magazine can be broken due to mutual vibration and rattle between the nose member and the magazine caused by the nail driving operation. Further, the present invention aims at providing a nailing machine and its structure, which eliminate the above drawbacks.

In order to attain the above object, there is provided the following method for fitting a magazine to a nose member of a nailing machine. The nailing machine includes the nose member disposed in the leading end portion of a main body, and the straight-sheath-shaped magazine, which is mounted in an opening formed in the side surface of the nose member for supplying sequentially the connected nails to the nose member. In the provided method for fitting the magazine to the nose member of the nailing machine, an elastic member is pressed in into a clearance provided between the nose member and the magazine, when the magazine is fit to the nose member.

Moreover, the present invention also provides a structure for a nailing machine including a main body, a nose member having a damper receiving portion provided in an upper end portion thereof, and a magazine. The structure includes at least one clearance provided between the nose member and the magazine, wherein an elastic member is pressed in into said clearance.

Further, the present invention provides a nailing machine including the above structure.

DETAILED DESCRIPTION OF THE PREFERRED EMBODIMENTS

Hereinafter, a preferred embodiment of the present invention will be described with reference to the accompanying drawings.

Figure 1:
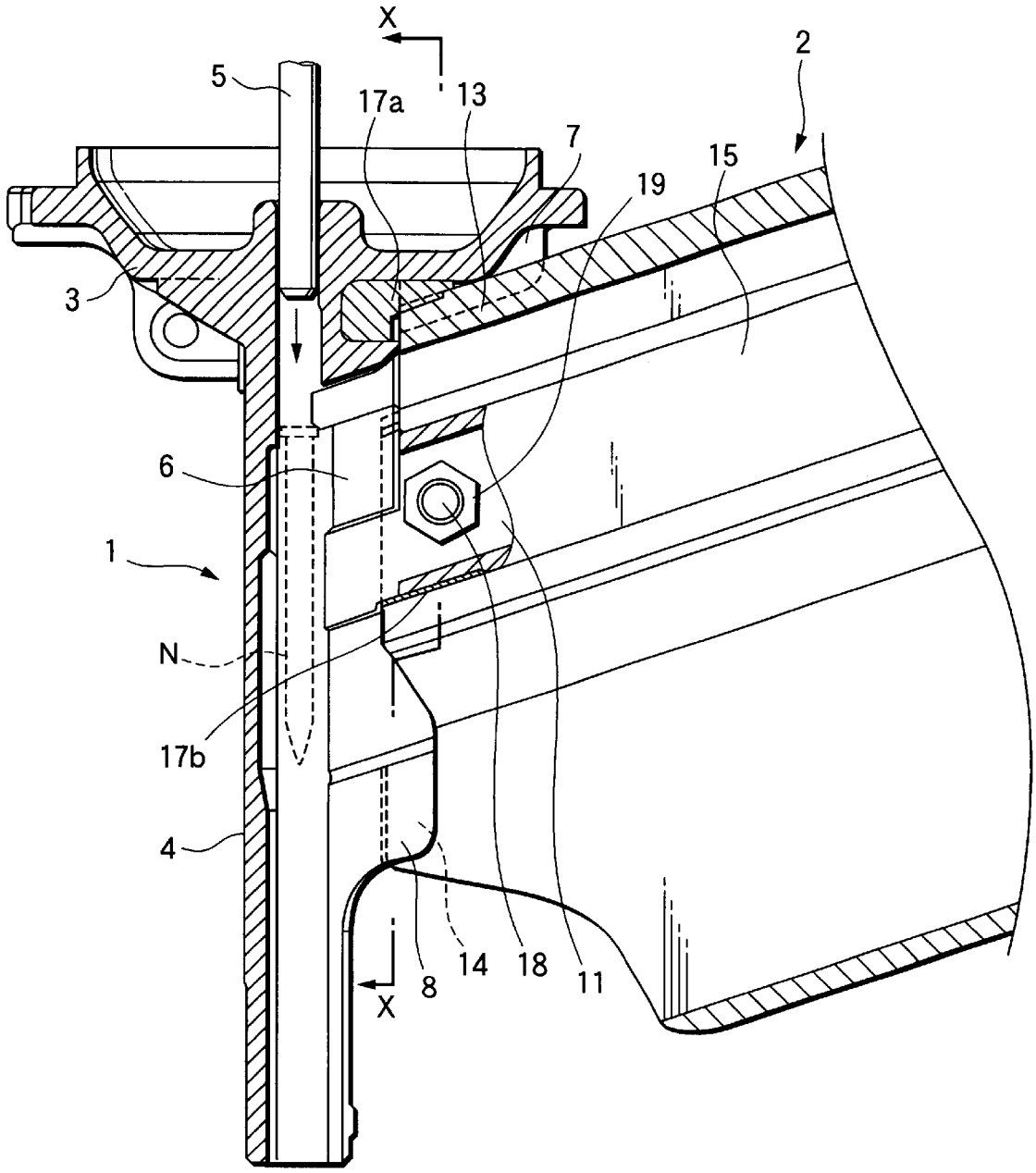
FIG. 1 is a side view of the main portions of a nose member and a magazine of a nailing machine according to the present invention.

In FIG. 1, reference character 1 designates a nose member which is disposed on the leading end portion of a nailing machine, and 2 stands for a magazine.

The nose member 1 is disposed on the leading end portion of a main body of the nailing machine and is used to drive the leading nail N of stick-shaped connected nails supplied thereto. The nose member 1 is molded with lost wax process and includes a dish-shaped damper receiving portion 3, which is formed in the upper end portion thereof, and a cylindrical-shaped portion 4, which is extended downward from the central portion of the damper receiving portion 3. A driver 5 for driving a nail is slidably stored in the cylindrical-shaped portion 4. In the upper portion of the nose member 1, a main body of the nailing machine is disposed. In the nailing machine main body, a hammering mechanism is disposed; and, this hammering mechanism can drive the driver 5 for driving a nail. The structures of these components are the same as those of a conventional nailing machine; therefore, the description thereof is omitted here.

The cylindrical-shaped portion 4 is opened on one side thereof. In the lower surface of the damper receiving portion 3 and the opening 6 of the cylindrical-shaped portion 4, as shown in FIGS. 1 and 3, a pair of mounting pieces 7, 7 as well as a pair of mounting pieces 8, 8, are disposed laterally.

Figure 2:
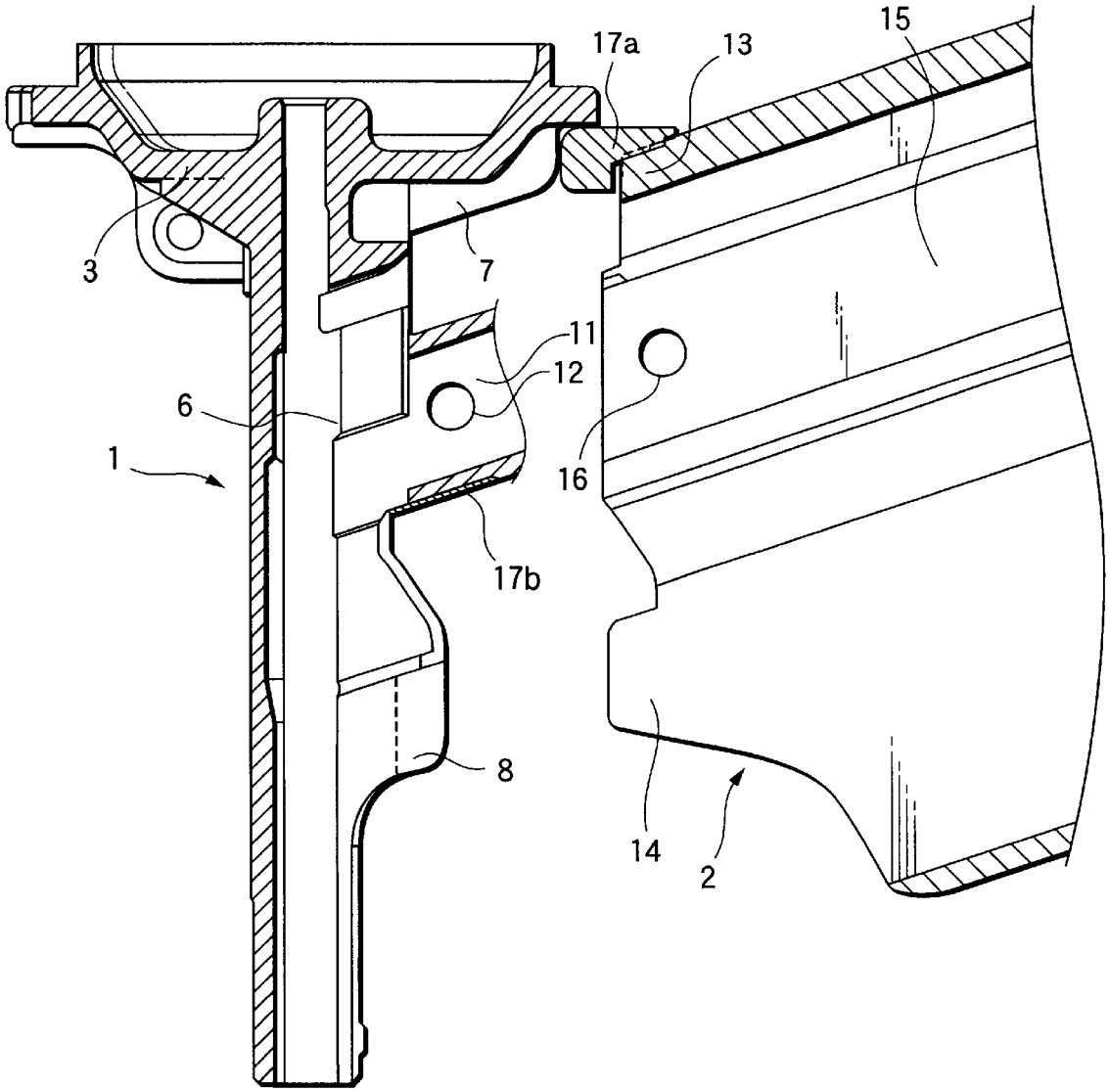
FIG. 2 is a side view of the nose member and the magazine, showing a state in which the magazine is fit to the nose member.
Figure 3:
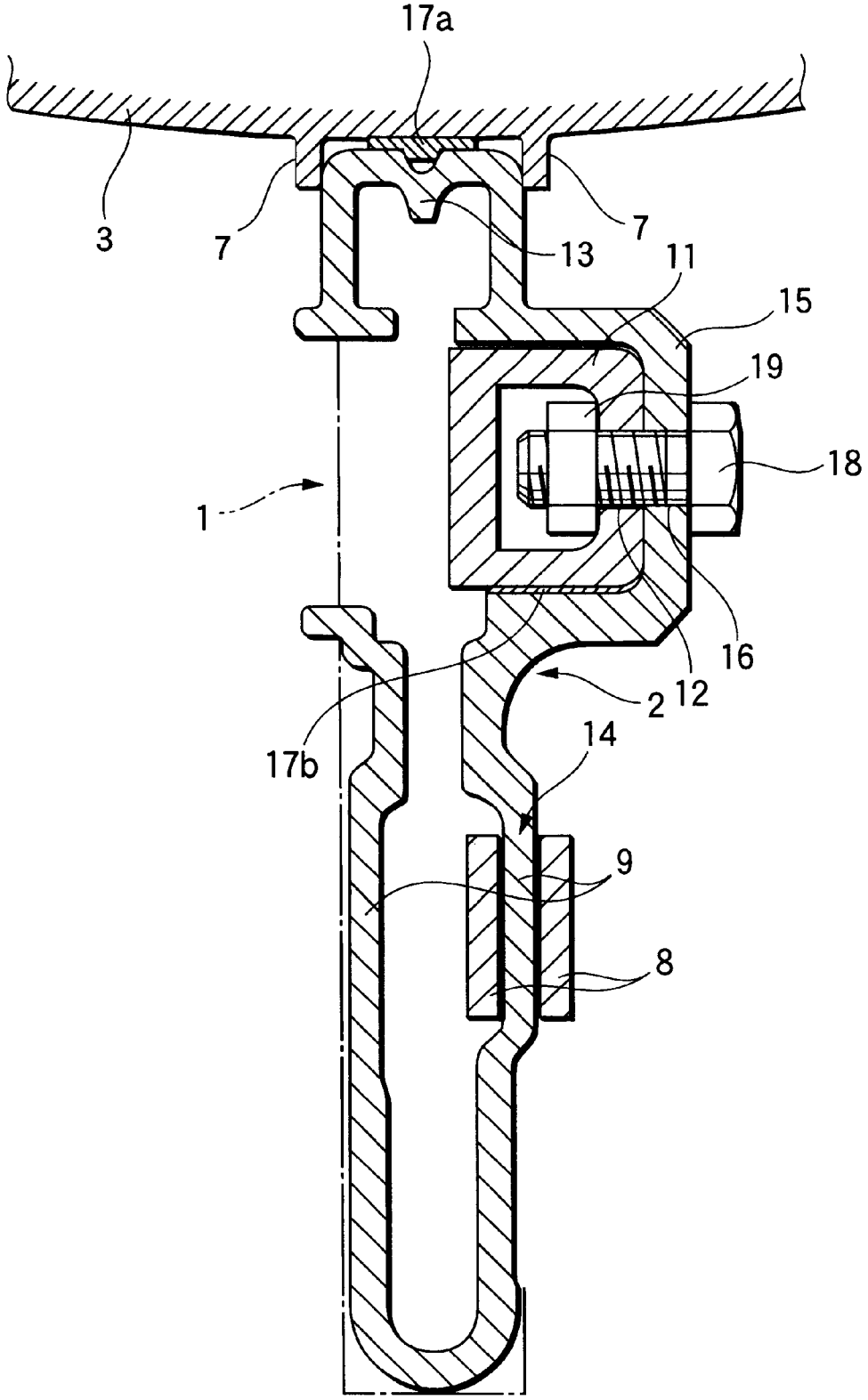
FIG. 3 is a section view taken along the line X—X shown in FIG. 1.

Further, slightly upward in the opening 6, as shown in FIGS. 2 and 3, a bolt receiving portion 11 having a rectangular-shaped section is formed projectingly. Outside the bolt-receiving portion 11, a bolt insertion hole 12 is formed.

On the other hand, the magazine 2 is an extruded member of aluminum and is shaped like a straight sheath for storing stick-shaped connected nails therein. The magazine 2 is to be connected to the opening 6 formed on one side of the nose member 1 and is able to supply the connected nails to the nose member 1 sequentially. Although not shown, in the interior portion of the magazine 2, a pusher is disposed for pushing out the connected nails to the side toward the nose member 1.

In the portions of the magazine 2 that correspond to the mounting pieces 7, 7 and 8, 8 of the nose member 1, fitting portions 13, 14, are respectively formed.

Further, on the slightly upper portion of one side wall of the magazine 2, more specifically, at the position of the magazine 2 corresponding to the bolt receiving portion 11 of the nose member 1, a projecting portion 15 is disposed, which extends in the longitudinal direction of the magazine 2 and has a substantially U-shaped section. On the leading end side of the projecting portion 15, a bolt insertion hole 16 is formed, which corresponds to the bolt insertion hole of the bolt receiving portion 11. On the lower portions of the two side walls of the magazine 2, more specifically, at the positions of the magazine 2 that are situated slightly downwardly of the projecting portion 15 (the positions corresponding to the mounting pieces 8 of the lower portion of the nose member 1), as shown in FIG. 3, second projecting portions 9, 9 are disposed.

Next, when the magazine 2 is fit to the nose member 1, as shown in FIG. 1, thin rubber-like elastic members 17*a*, 17*b* are previously stuck on the fitting portion 13 of the upper portion of the nose member 1 and on the inside (the lower surface) of the projecting portion 15 of the magazine, respectively. The fitting portion 13 of the leading end portion of the magazine 2 is fitted to the inside of the mounting pieces 7, 7 of the upper portion of the nose member 1. Further, the fitting portion 14 of the leading end lower portion of the magazine is fitted with the mounting pieces 8, 8, so that the portion 14 is sandwiched between them. At the same time, the bolt receiving portion 11 of the nose member 1 is fitted to the inside of the projecting portion 15 of the magazine 2. In this case, as shown in FIG. 3, since the bolt insertion holes 12, 16 of the bolt-receiving portion 11 and magazine 2 are matched to each other, a fixing bolt 18 is inserted into these bolt insertion holes 12, 16. Thus, it can be threadedly engaged with a nut 19 which is previously disposed in the interior portion of the bolt receiving portion 11. The magazine 2 is able to fasten to the nose member 1 by the above manner. However, the fixing means is not limited to the above-mentioned bolt 18 and nut 19, but other known means can be adopted.

The following are the reasons why the elastic members 17*a*, 17*b* are disposed at the positions shown in FIGS. 1 and 3. With respect to the elastic member 17*a* disposed at the upper position, if the distance between the elastic member 17*a* and the center of the fixed portion between the nose member 1 and the magazine 2 is set longer, a moment can be made large when vibration with shaking occurs with making the fixed portion as its center. Therefore, vibration can be effectively suppressed. On the other hand, the elastic member 17*b*, disposed at the lower position, is disposed at a position symmetrical with the elastic member 17*a* with respect to the fixed portion. This is because the elastic member 17*b* as shown in the figures is disposed where it can be fit most easily. Moreover, the effect of disposing the elastic member 17*b* can be obtained without any problems.

By fitting the members as the above, since the elastic members 17*a*, 17*b* are pressed in into the clearance provided between the nose member 1 and the magazine 2 as shown in FIG. 3, the clearance that is provided between the nose member 1 and the magazine 2 is eliminated. This can prevent the nose member 1 and the magazine 2 from rattling with respect to each other.

Further, the elastic members 17*a*, 17*b* are pressed in into the clearance between the nose member 1 and the magazine 2, and the nose member 1 and the magazine 2 are disposed in the surfaces which are opposed to each other in the vertical direction. Therefore, even if the magazine 2 is shaken and vibrated about the fixing bolt 18 with respect to the nose member 1 in the nail driving operation, the above-mentioned vibrations can be dampened effectively and the magazine 2 can be positively prevented from breakage.

Further, since there can be provided a allowance for the dimensional tolerance between the nose member 1 and the magazine 2 to thereby eliminate the need to set a severe dimensional accuracy, the nose member 1 and magazine 2 can be produced at a low cost and with high efficiency.

The elastic members 17*a*, 17*b* may be formed of an elastic material; that is, not only rubber but also synthetic resin can be used as the elastic material of the elastic members 17*a*, 17*b*. Moreover, the mounting positions of the elastic members 17*a*, 17*b* are not limited to the positions specified in the illustrated embodiment but the elastic members 17*a*, 17*b* can disposed at other positions, provided that the positions are capable of absorbing the clearance between the nose member 1 and magazine 2.

While only certain embodiments of the invention have been specifically described herein, it will be apparent that numerous modifications may be made thereto without departing from the spirit and scope of the invention.

What is claimed is:

1. A method for fitting a nailing machine including a main body, a nose member having an opening formed on a side surface thereof and disposed in a leading end portion of the main body for driving one of connected nails, and a magazine mounted in the opening of the nose member for sequentially supplying the connected nails to the nose member, said method comprising:

fitting the magazine into the nose member by fitting a receiving portion of the nose member to the inside of a projecting portion of the magazine, wherein an elastic damper member is pressed into a clearance provided between the nose member and the magazine; and wherein the clearance is provided between the receiving portion of the nose member and the inside of the protecting portion.

2. The method for fitting a nailing machine according to claim 1, further comprising:

sticking the elastic member on the magazine before fining the magazine to the nose member.

3. The method for fitting a nailing machine according to claim 1, wherein the step of fitting the magazine into the nose member further comprises the step of:

pressing the elastic member into the clearance and in contact with the nose member and the magazine.

4. A structure of a nailing machine including a main body, a nose member having an opening formed on a side surface thereof and disposed in a leading end portion of the main body for driving one of connected nails, and a magazine mounted in the opening of the nose member, said structure comprising:

at least one clearance provided between the nose member and the magazine, wherein at least one elastic member is pressed into said clearance, wherein the magazine is fit to the nose member by connecting a projecting portion of the magazine to a bolt receiving portion of the nose member with a fixing bolt and a nut, and wherein said clearance is provided between the bolt receiving portion and an inside of the projecting portion.

5. The structure of a nailing machine according to claim 4, wherein said clearance is provided between the magazine and a damper receiving portion provided in an upper end portion of the nose member.

6. The structure of a nailing machine according to claim 4, wherein the elastic member is made of rubber.

7. The structure of a nailing machine according to claim 4, wherein the elastic member is made of synthetic resin.

8. The structure of a nailing machine according to claim 4, wherein said elastic member is in contact with the nose member and the magazine.

9. A structure of a nailing machine including a main body, a nose member having an opening formed on a side surface thereof and disposed in a leading end portion of the main body for driving one of connected nails, and a magazine mounted in the opening of the nose member, said structure comprising:

at least one clearance provided between the nose member and the magazine, wherein at least one elastic member is pressed into said clearance, wherein the magazine is fit to the nose member by connecting a projecting portion of the magazine to a bolt receiving portion of the nose member with a fixing bolt and a nut, and wherein a first clearance is provided between the magazine and a damper receiving portion provided in an upper end portion of the nose member, and wherein a second clearance is provided between the bolt receiving portion and an inside of the projecting portion.

10. A nailing machine comprising:

a main body;

a nose member having an opening formed on a side surface thereof and disposed in a leading end portion of the main body for driving one of connected nails;

a magazine mounted in the opening of said nose member; and an elastic member, wherein said elastic member is pressed into a clearance provided between said nose member and said magazine, wherein said magazine is fit to said nose member by connecting a projecting portion of said magazine to a bolt receiving portion of said nose member with a fixing bolt and a nut, and wherein the clearance is provided between the bolt receiving portion and an inside of the projecting portion.

11. The nailing machine according to claim 10, wherein said nose member includes a damper receiving portion provided in an upper end portion of said nose member, and wherein the clearance is provided between the magazine and the damper receiving portion of the nose member.

12. The nailing machine according to claim 10, wherein said elastic member is in contact with the nose member and the magazine.

13. A nailing machine comprising:

a main body;

a nose member having an opening formed on a side surface thereof and disposed in a leading end portion of the main body for driving one of connected nails;

a magazine mounted in the opening of said nose member; and an elastic member, wherein said elastic member is pressed into a clearance provided between said nose member and said magazine, wherein said magazine is fit to said nose member by connecting a projecting portion of said magazine to a bolt receiving portion of said nose member with a fixing bolt and a nut, and wherein a first clearance is provided between said magazine and a damper receiving portion provided in an upper end portion of said nose member, and wherein a second clearance is provided between the bolt receiving portion and an inside of the projecting portion.

* * * * *